US010723581B2

(12) United States Patent
Asami et al.

(10) Patent No.: US 10,723,581 B2
(45) Date of Patent: Jul. 28, 2020

(54) SHEET PROCESSING APPARATUS AND IMAGE FORMING SYSTEM INCORPORATING THE SAME

(71) Applicants: Shinji Asami, Tokyo (JP); Tomohiro Furuhashi, Kanagawa (JP); Michitaka Suzuki, Kanagawa (JP); Tomomichi Hoshino, Kanagawa (JP); Fumiharu Yoneyama, Kanagawa (JP); Makoto Hidaka, Tokyo (JP); Koki Sakano, Kanagawa (JP); Akira Kunieda, Tokyo (JP); Takuya Morinaga, Tokyo (JP); Yohsuke Haraguchi, Kanagawa (JP)

(72) Inventors: Shinji Asami, Tokyo (JP); Tomohiro Furuhashi, Kanagawa (JP); Michitaka Suzuki, Kanagawa (JP); Tomomichi Hoshino, Kanagawa (JP); Fumiharu Yoneyama, Kanagawa (JP); Makoto Hidaka, Tokyo (JP); Koki Sakano, Kanagawa (JP); Akira Kunieda, Tokyo (JP); Takuya Morinaga, Tokyo (JP); Yohsuke Haraguchi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/274,346

(22) Filed: Feb. 13, 2019

(65) Prior Publication Data

US 2019/0284010 A1 Sep. 19, 2019

(30) Foreign Application Priority Data

Mar. 19, 2018 (JP) ..... 2018-051531

(51) Int. Cl.
*B65H 45/14* (2006.01)
*B65H 29/12* (2006.01)

(52) U.S. Cl.
CPC ..... *B65H 45/14* (2013.01); *B65H 29/125* (2013.01); *B65H 2801/27* (2013.01)

(58) Field of Classification Search
CPC ..... B65H 45/16; B65H 43/00; B65H 2701/13212; B65H 2301/5123; B65H 2301/51232; B31F 1/0035
(Continued)

(56) References Cited

U.S. PATENT DOCUMENTS 9,555,998 B2 * 1/2017 Watanabe ..... B65H 9/006
9,637,342 B2 * 5/2017 Hari ..... B65H 37/06
(Continued)

FOREIGN PATENT DOCUMENTS

JP 2005-225675 8/2005
JP 2014-101164 6/2014
JP 2017-214225 12/2017

*Primary Examiner* — Leslie A Nicholson, III
(74) *Attorney, Agent, or Firm* — Harness, Dickey & Pierce, P.L.C.

(57) ABSTRACT

A sheet processing apparatus includes a first conveyer to convey a sheet, a first folding device to fold the sheet and put a crease in the sheet, a second conveyer to convey the sheet folded by the first folding device, a second folding device to fold the sheet and put a crease in the sheet, and a guide. The first conveyer and the second conveyer are rotatable in reverse. The guide guides the sheet conveyed downstream from the first conveyer and the sheet conveyed downstream from the second conveyer.

12 Claims, 11 Drawing Sheets

(58) Field of Classification Search
USPC ..... 270/32, 45
See application file for complete search history.

(56) References Cited

U.S. PATENT DOCUMENTS

| | | | | |
|---|---|---|---|---|
| 9,993,987 | B2 * | 6/2018 | Suzuki | B31F 1/0025 |
| 2014/0141956 | A1 | 5/2014 | Suzuki et al. | |
| 2014/0203486 | A1 | 7/2014 | Sugiyama et al. | |
| 2014/0203487 | A1 | 7/2014 | Hoshino et al. | |
| 2014/0203488 | A1 | 7/2014 | Hidaka et al. | |
| 2014/0206516 | A1 | 7/2014 | Hata et al. | |
| 2014/0206517 | A1 | 7/2014 | Kikuchi et al. | |
| 2014/0206518 | A1 | 7/2014 | Hidaka et al. | |
| 2014/0206519 | A1 | 7/2014 | Hoshino et al. | |
| 2014/0213425 | A1 | 7/2014 | Sugiyama et al. | |
| 2014/0336031 | A1 | 11/2014 | Suzuki et al. | |
| 2014/0364295 | A1 | 12/2014 | Watanabe et al. | |
| 2015/0031520 | A1 | 1/2015 | Nakada et al. | |
| 2015/0225201 | A1 | 8/2015 | Watanabe et al. | |
| 2015/0266697 | A1 | 9/2015 | Saito et al. | |
| 2016/0060072 | A1 | 3/2016 | Watanabe et al. | |
| 2016/0068359 | A1 | 3/2016 | Suzuki et al. | |
| 2016/0114999 | A1 | 4/2016 | Suzuki et al. | |
| 2016/0115000 | A1 | 4/2016 | Sugiyama et al. | |
| 2018/0201466 | A1 | 7/2018 | Saito et al. | |
| 2018/0236744 | A1 | 8/2018 | Suzuki et al. | |
| 2018/0257900 | A1 | 9/2018 | Suzuki et al. | |

* cited by examiner

SHEET PROCESSING APPARATUS AND IMAGE FORMING SYSTEM INCORPORATING THE SAME

CROSS-REFERENCE TO RELATED APPLICATIONS

This patent application is based on and claims priority pursuant to 35 U.S.C. § 119 to Japanese Patent Application No. 2018-051531, filed on Mar. 19, 2018, in the Japanese Patent Office, the entire disclosure of which is hereby incorporated by reference herein.

BACKGROUND

Technical Field

This disclosure relates to a sheet processing apparatus and an image forming system incorporating the sheet processing apparatus.

Background Art

A sheet processing apparatus is known that includes a first conveyer that conveys a sheet and is rotatable in reverse, a first folding device to fold the sheet and put a crease in the sheet, a second conveyer that conveys the sheet folded by the first folding device and is rotatable in reverse, and a second folding device to fold the sheet and put a crease in the sheet.

SUMMARY

This specification describes an improved sheet processing apparatus that includes a first conveyer to convey a sheet, a first folding device to fold the sheet and put a crease in the sheet, a second conveyer to convey the sheet folded by the first folding device, a second folding device to fold the sheet and put a crease in the sheet, and a guide. The first conveyer and the second conveyer are rotatable in reverse. The guide guides the sheet conveyed downstream from the first conveyer and the sheet conveyed downstream from the second conveyer.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
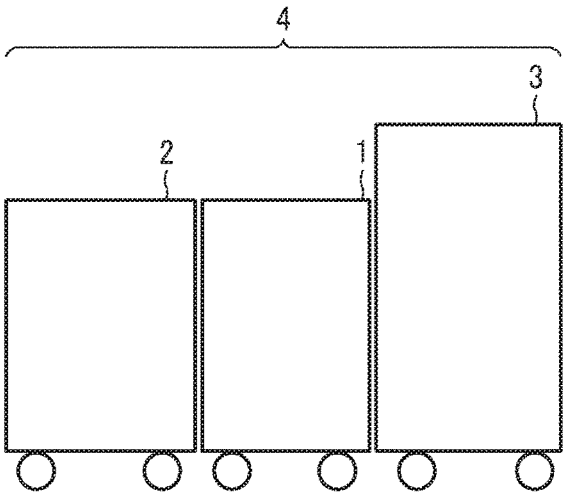
FIG. 1 is a schematic diagram illustrating a system configuration of an image forming system including an image forming apparatus and a plurality of sheet processing apparatuses according to embodiments of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and all the components or elements described in the embodiments of this disclosure are not necessarily indispensable.

Referring now to the drawings, embodiments of the present disclosure are described below. In the drawings illustrating the following embodiments, the same reference codes are allocated to elements having the same function or shape and redundant descriptions thereof are omitted below.

FIG. 1 is a schematic diagram illustrating a system configuration of an image forming system 4 according to an embodiment of the present disclosure, including an image forming apparatus and a plurality of sheet processing apparatuses. The image forming system 4 in the present embodiment includes a folding apparatus 1 and a post-processing apparatus 2, each of which serves as the sheet processing apparatus, provided in this order at later stages of the image forming apparatus 3, as illustrated in FIG. 1.

The image forming apparatus 3 forms an image on a sheet based on image data that is input to the image forming apparatus 3 or obtained by scanning. The image forming apparatus 3 may be, for instance, a copier, a printer, a facsimile machine, or a multifunction peripheral having at least two functions of the foregoing machines. The image forming apparatus 3 may use any known image forming method, such as electrophotography or droplet discharge. The image forming apparatus 3 in the present embodiment is a copier using the electrophotography.

Examples of the post-processing apparatus 2 include a punch apparatus that punches a hole in the sheet, a sheet binding apparatus in which a stapler or the like binds sheets and make a sheet bundle, and a sorter that sorts and ejects a sheet on which an image formed into each of a plurality of ejection trays.

Figure 2:
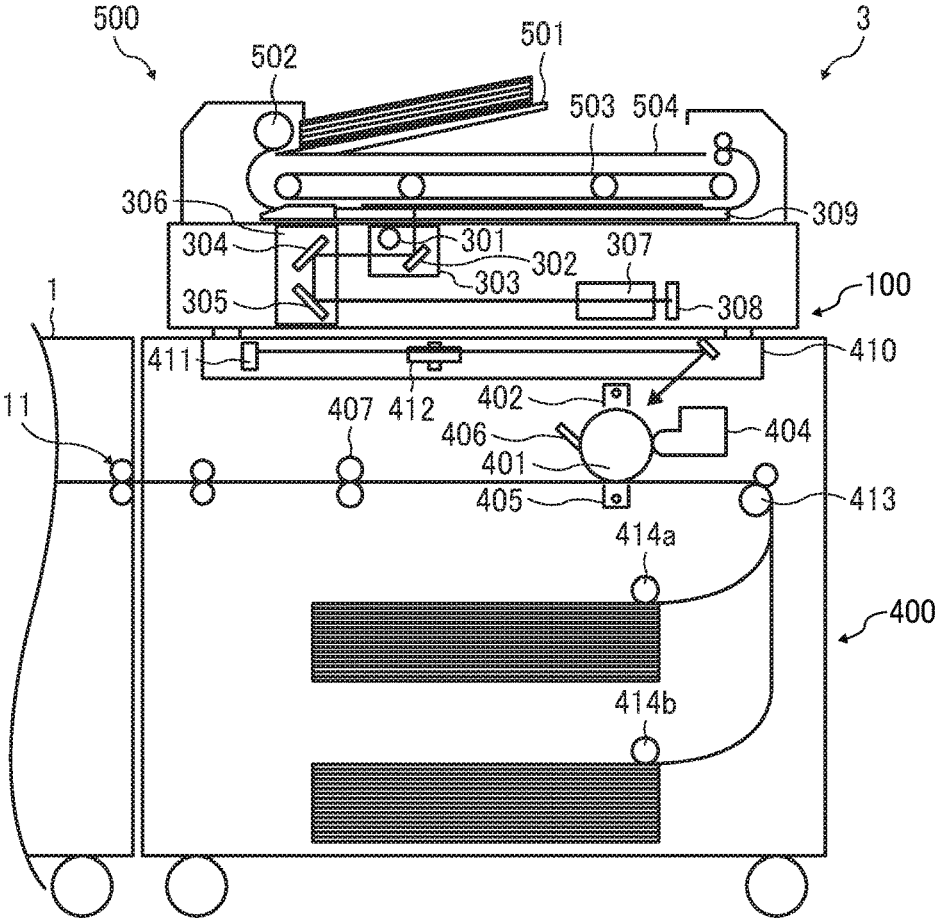
FIG. 2 is a schematic configuration diagram of the image forming apparatus provided in the image forming system of FIG. 1.

FIG. 2 is a schematic configuration diagram of the image forming apparatus 3 provided in the image forming system 4 according to the present embodiment.

In an image forming apparatus main body 400, feeding cassettes to store sheets serving as recording media are disposed below an image forming section. After the sheet stored in the feeding cassettes is fed by the feeding roller 414*a* or 414*b*, the sheet is conveyed upward along a predetermined conveyance path. Then the sheet reaches a pair of registration rollers 413.

The image forming section includes a photoconductor drum 401 as an image bearer, a charger 402, an exposure device 410, a developing device 404, a transfer device 405, and a cleaner 406.

The charger 402 uniformly charges a surface of the photoconductor drum 401. The exposure device 410 serving as a latent image forming device forms an electrostatic latent image on the photoconductor drum 401 based on image data read by a scanner 100. The developing device 404 adheres toner to the electrostatic latent image formed on the photoconductor drum 401 to form a visible image as a toner image. The transfer device 405 transfers the toner image from the photoconductor drum 401 onto the sheet. The cleaner 406 removes toner remaining on the photoconductor drum 401 after the transfer.

On the downstream side of the image forming section in a sheet conveyance direction, a fixing device 407 to fix the toner image on the sheet is disposed.

The exposure device 410 includes a laser unit 411 to emit a laser beam based on the image data under a control of a controller and a polygon mirror 412 to scan the laser beam from the laser unit 411 in a rotation axis direction of the photoconductor drum 401 which is called a main scanning direction.

An automatic document feeder (ADF) 500 is mounted on the scanner 100.

The automatic document feeder (ADF) 500 includes a platen 501, a separation and feed roller 502, an original conveyor belt 503, and an original ejection tray 504.

When the automatic document feeder (ADF) 500 receives an instruction to start scanning originals placed on the platen 501, the separation and feed roller 502 feeds the originals one by one from the platen 501 to the original conveyor belt 503. The original conveyor belt 503 moves the originals onto a platen glass 309 on which each of the originals temporally stops.

Then, the scanner 100 reads the image data of the original temporarily stopped on the platen glass 309. Thereafter, the original conveyor belt 503 resumes conveyance of the original to eject the original onto the original ejection tray 504.

A more detailed description is now provided of an image reading operation and an image forming operation.

In addition to the platen glass 309, the scanner 100 includes a first carrier 303, a light source 301 and a mirror 302 provided on the first carrier 303, a second carrier 306, mirrors 304 and 305 provided on the second carrier 306, a lens 307, and a charge coupled device (CCD) 308. The light source 301 is lighted when the automatic document feeder (ADF) 500 conveys the original onto the platen glass 309 or when a user places an original on the platen glass 309 and directs the image forming apparatus to start copying via an operation panel. In the meantime, the first carrier 303 and the second carriers 306 move along a guide rail.

The light source 301 emits light to the original positioned on the platen glass 309. Reflected light from the original is guided to the CCD 308 via the mirror 302, the mirrors 304 and 305, and the lens 307. The CCD 308 receives the reflected light and reads the image data of the original. The image data is converted from analog data to digital data by an analog-to-digital (A/D) converter. The digital data is sent from a data output unit to the controller in the image forming apparatus main body 400.

On the other hand, the image forming apparatus main body 400 starts to drive the photoconductor drum 401, and after a rotation speed of the photoconductor drum 401 reaches a predetermined speed, the charger 402 uniformly charges the surface of the photoconductor drum 401. The exposure device 410 forms the electrostatic latent image on the charged surface of the photoconductor drum 401 based on the image data read by the scanner 100.

Thereafter, the developing device 404 develops the electrostatic latent image on the surface of the photoconductor drum 401 into a toner image. In the meantime, the feeding roller 414*a* or 414*b* feeds the sheet stored in the feeding cassette, and the pair of registration rollers 413 temporarily stops the sheet.

The pair of registration rollers 413 feeds the sheet to a transfer portion opposite the transfer device 405 when a leading edge of the toner image formed on the surface of the photoconductor drum 401 reaches the transfer portion. While the sheet passes through the transfer portion, a transfer electric field transfers the toner image formed on the surface of the photoconductor drum 401 onto the sheet.

The sheet on which the toner image is transferred is conveyed to the fixing device 407, subjected to a fixing process by the fixing device 407, and then ejected to the folding apparatus 1 at the subsequent stage. The cleaner 406 removes residual toner which is not transferred onto the sheet at the transfer portion and remains on the surface of the photoconductor drum 401.

Figure 3:
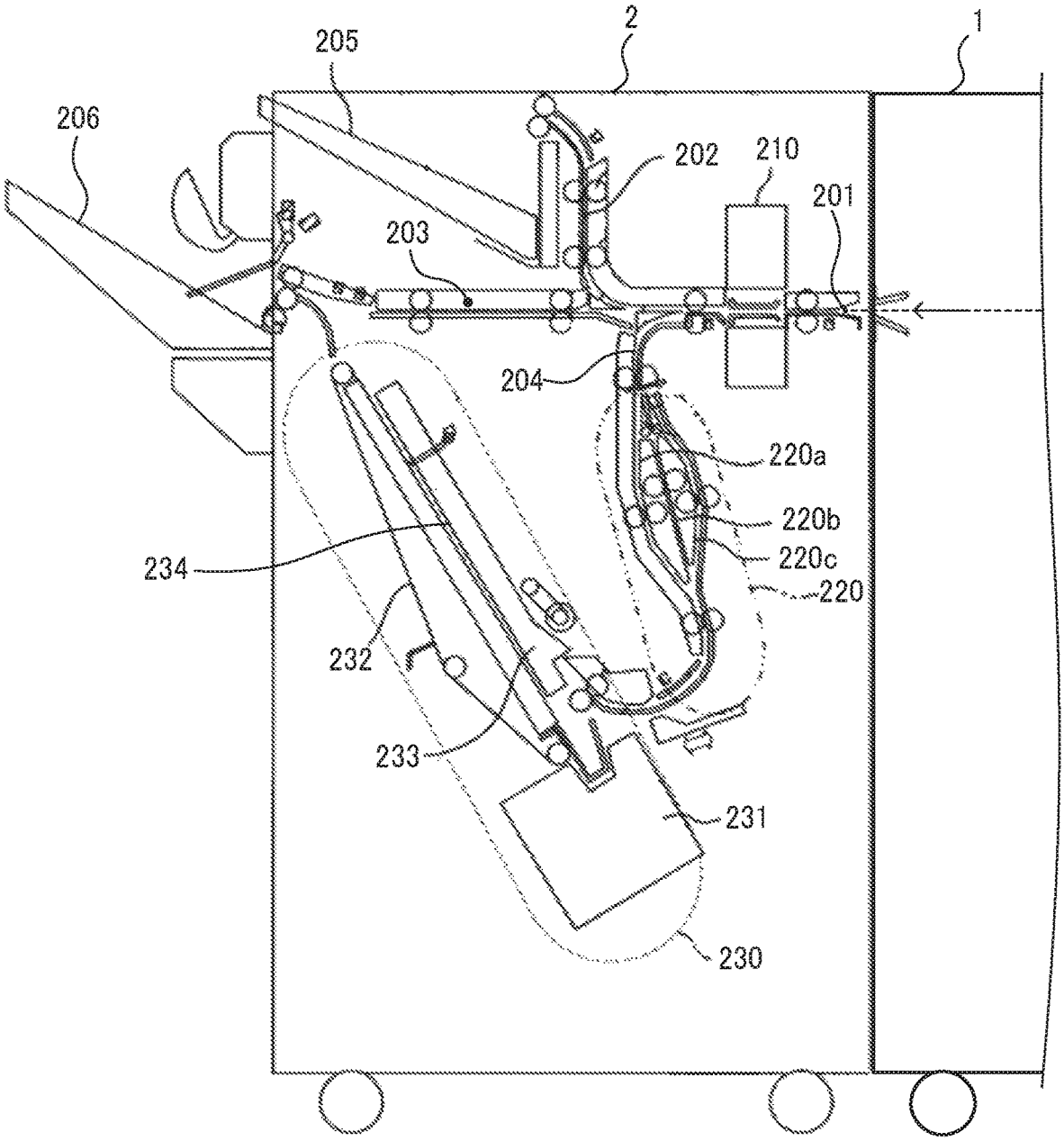
FIG. 3 is a schematic configuration diagram of a post-processing apparatus provided in the image forming system of FIG. 1.

FIG. 3 is a schematic configuration diagram of the post-processing apparatus 2 provided in the image forming system 4 according to the embodiment.

The post-processing apparatus 2 includes an introduction path 201 to receive the sheet from the folding apparatus 1 and three paths diverging from the introduction path 201, that is, a first ejection path 202 to eject the sheet to an upper tray 205, a second ejection path 203 to eject the sheet to a shift tray 206, and a conveyance path 204 to convey the sheet to a sheet binding device 230. On the introduction path 201, a punching device 210 is disposed to puncture a punch hole in the sheet. The punching device 210 punctures the punch hole at a predetermined position in a folded sheet, a folded sheet bundle, and a single sheet that has been conveyed without being folded, which are ejected from the folding apparatus 1.

On the conveyance path 204, an overlay device 220 is disposed. The overlay device 220 includes three conveyance paths 220*a*, 220*b*, and 220*c*. Sorting the sheets to each conveyance path and temporarily waiting on each conveyance path allows up to three sheets to be overlaid and conveyed.

The sheet binding device 230 includes a processing tray 233, a jogger fence 234 to align a plurality of sheets (that is a sheet bundle) in the processing tray 233, a stapler unit 231 to perform binding processing on the sheet bundle in the processing tray 233, and a conveyance belt 232 to convey the sheet bundle subjected to binding processing toward the shift tray 206.

When the predetermined number of sheets which are folded or not folded is conveyed to the processing tray 233, the jogger fence 234 performs the alignment processing on the sheet bundle in the processing tray 233. Then, after the stapler unit 231 performs the binding processing on the sheet bundle in the processing tray 233, the conveyance belt 232 conveys the bound sheet bundle, and the bound sheet bundle is ejected to the shift tray 206.

Figure 4:
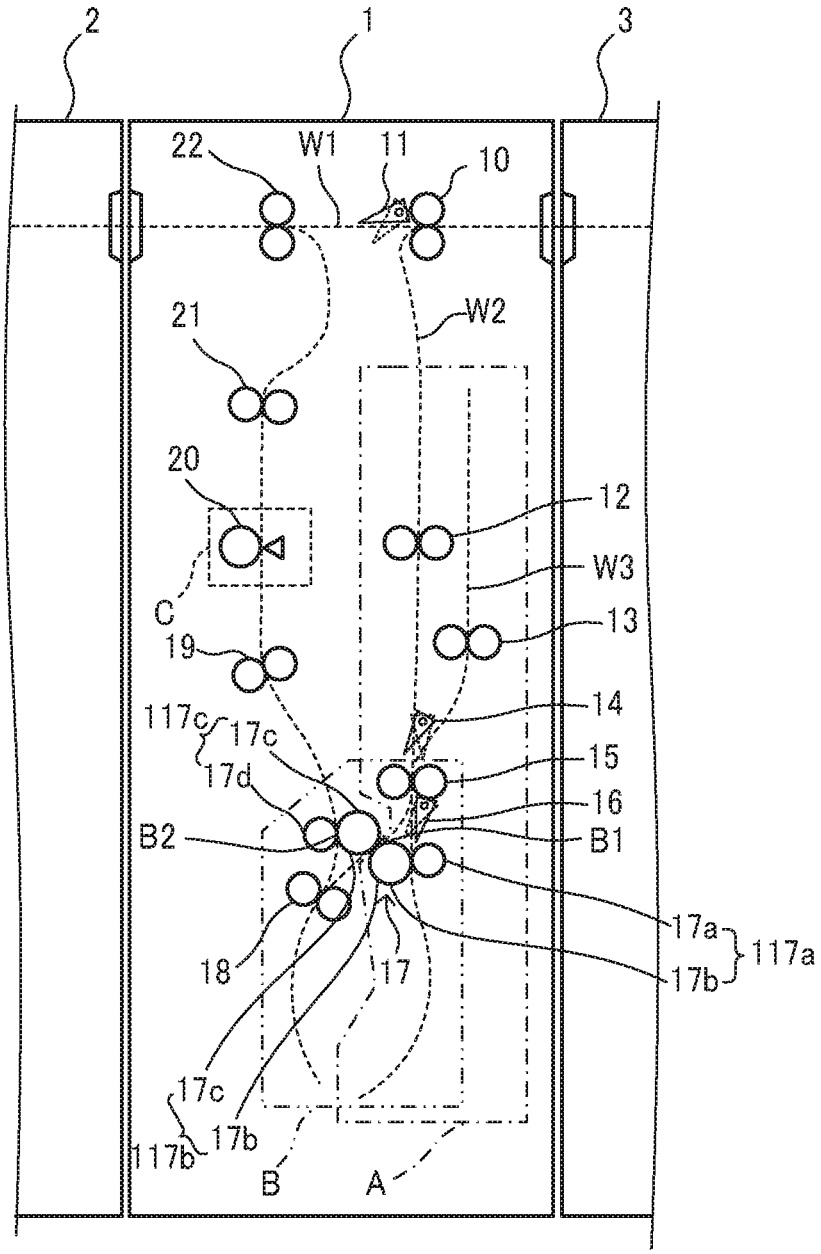
FIG. 4 is a schematic configuration diagram of a folding apparatus provided in the image forming system of FIG. 1.

FIG. 4 is a schematic configuration diagram of a folding apparatus 1 provided in the image forming system 4 according to the embodiment.

As illustrated in FIG. 4, the folding apparatus 1 includes an entry roller pair 10 to convey the sheet received from the image forming apparatus 3. On the downstream side from the entry roller pair 10, the sheet conveyance path is divided into a folding processing conveyance path W2 to convey the sheet and perform the folding processing and a through conveyance path W1 to convey the sheet without the folding processing. A first bifurcating claw 11 is disposed at a fork between the folding processing conveyance path W2 and the through conveyance path W1. The first bifurcating claw 11 guides the sheet to the through conveyance path W1 or the folding processing conveyance path W2.

The folding processing conveyance path W2 includes an overlay section A to overlap a plurality of sheets, a folding section B to fold one sheet or sheets overlaid in the overlay section A, and an additional folding section C in which the folded sheet is additionally folded.

The overlay section A includes a registration roller pair 15, a first conveyance roller pair 117*a* including a first pressing roller 17*a* in a folding mechanism 17 described later and a first folding roller 17*b*, and a conveyance roller pair 12 to convey the sheet toward the registration roller pair 15. The overlay section A also includes a switchback conveyance path W3 that branches from the folding processing conveyance path W2 between the conveyance roller pair 12 and the registration roller pair 15 and a switchback conveying roller pair 13 disposed in the switchback conveyance path W3. The registration roller pair 15 conveys the sheet in a reverse direction (conveys in a direction opposite to the predetermined direction) to the switchback conveyance path W3. The overlay section A also includes a second bifurcating claw 14 disposed at a fork between the switchback conveyance path W3 and the folding processing conveyance path W2 from the conveyance roller pair 12 to the registration roller pair 15 to guide the sheet conveyed in the reverse direction (conveyed in the direction opposite to the predetermined direction) toward the switchback conveyance path W3.

The folding section B is disposed downstream of the overlay section A. The folding section B includes the registration roller pair 15, the folding mechanism 17, and a second conveyance roller pair 18. The folding mechanism 17 includes the first folding roller 17*b*, the first pressing roller 17*a* which contacts the first folding roller 17*b* to switch back the sheet, a second folding roller 17*c* which contacts the first folding roller 17*b* to form a first folding nip B1, and a second pressing roller 17*d* which contacts the second folding roller 17*c* to form a second folding nip B2. The driving force is transmitted to one of the plurality of rollers included in the folding mechanism 17, and the other rollers are driven to rotate.

A third bifurcating claw 16 is disposed downstream of the registration roller pair 15 to guide the sheet to the nip between the first folding roller 17*b* and the first pressing roller 17*a* or the first folding nip B1.

On the downstream side of the folding section B, the additional folding section C is disposed. The additional folding section C includes an additional folding roller 20. The additional folding roller 20 has a pressing convex portion, and the pressing convex portion presses the folded portion of the sheet, and the folded portion of the sheet is additionally folded.

Figure 5:
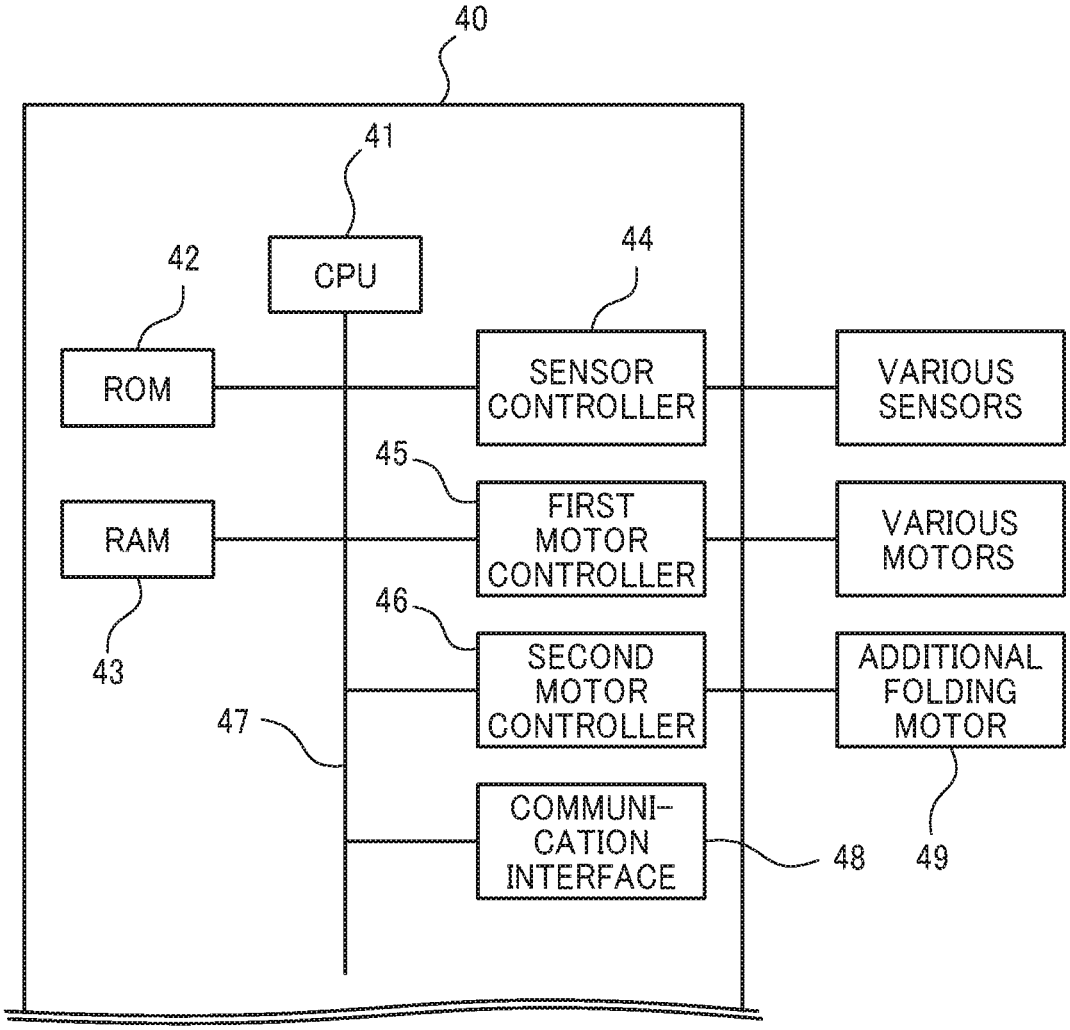
FIG. 5 is a block diagram of an example of a control circuit to control the folding apparatus of the image forming system of FIG. 1.

FIG. 5 is a block diagram of an example of a control circuit to control the folding apparatus 1 in the image forming system 4.

The controller 40 to control the folding apparatus 1 includes a Central Processing Unit (CPU) 41, a Read Only Memory (ROM) 42, a Random Access Memory (RAM) 43, a sensor controller 44 to control various sensors such as a paper detector disposed in the folding apparatus 1, a first motor controller 45 to control a plurality of conveyance motors which convey the sheet in the folding apparatus 1, a second motor controller 46 to control the additional folding motor 49 that drives the additional folding roller 20, and a communication interface 48.

These components are mutually electrically coupled via a bus line 47 such as an address bus or a data bus. The communication interface 48 communicates with the image forming apparatus 3 and the post-processing apparatus 2 in FIG. 1 and exchanges data necessary for control. The ROM 42 stores data and programs executed by the CPU 41. The CPU 41 executes a computer readable program stored in the ROM 42 to control the folding apparatus 1. The RAM 43 temporarily stores data when the CPU 41 executes the program.

FIGS. 6A to 6F are explanatory diagrams illustrating the sheet overlay operation executed by the overlay section A of the folding apparatus 1.

Figure 6A:
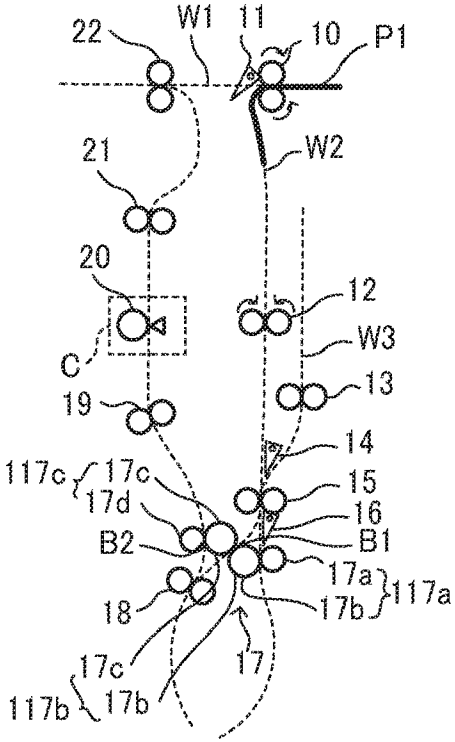
FIGS. 6A to 6F are explanatory diagrams illustrating a sheet overlay operation executed by an overlay device of the folding apparatus.

As illustrated in FIG. 6A, the entry roller pair 10 conveys the first sheet P1 to the folding processing conveyance path W2. A leading edge of the first sheet P1 conveyed to the folding processing conveyance path W2 contacts the registration roller pair 15 to correct the skew of the first sheet. However, this skew correction may not be performed.

Figure 6B:
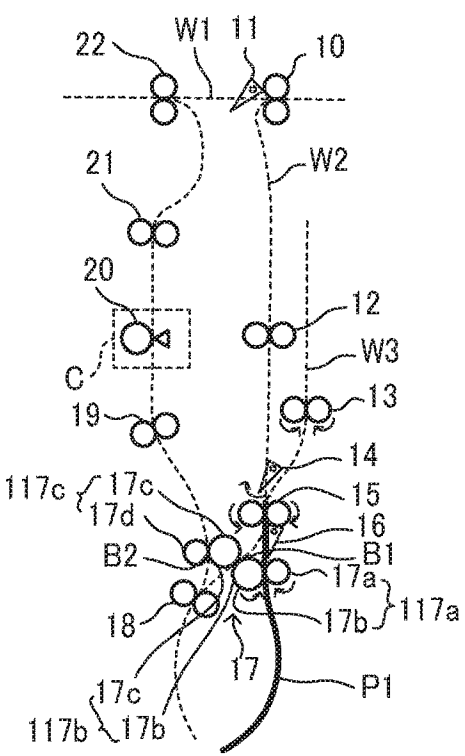
Figure 6C:
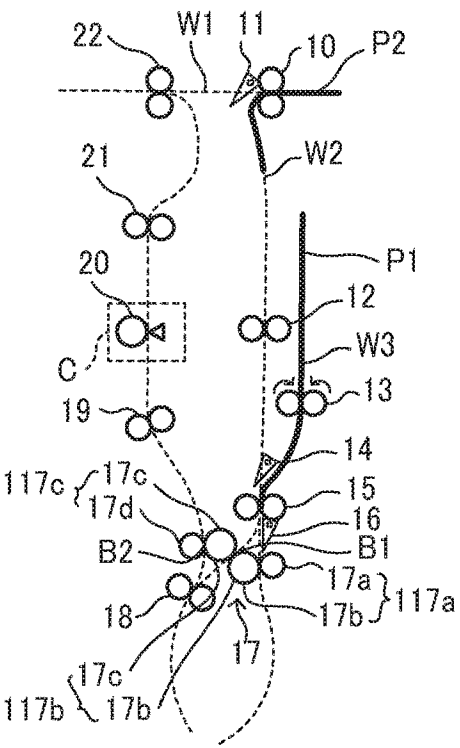

Next, the registration roller pair 15 and the first conveyance roller pair 117*a* serving as a first conveyance member including the first pressing roller 17*a* and the first folding roller 17*b* conveys the first sheet P1 in a predetermined direction which is called a regular direction. Next, when the trailing edge of the first sheet P1 passes through the fork between the folding processing conveyance path W2 and the switchback conveyance path W3, the conveyance of the first sheet P1 is stopped. Next, the second bifurcating claw 14 pivots in the clockwise direction in FIG. 6B, and the posture of the second bifurcating claw 14 is switched to guide the first sheet P1 to the switchback conveyance path W3. Next, as illustrated in FIG. 6B, the registration roller pair 15, the first conveyance roller pair 117*a*, and the switchback conveying roller pair 13 rotate in reverse. This reverse rotation conveys the first sheet P1 in a reverse direction that is the opposite direction to the predetermined direction, and the first sheet P1 is conveyed to the switchback conveyance path W3. When the leading edge of the first sheet P1 in the regular direction is conveyed to the switchback conveyance path W3, the switchback conveying roller pair 13 stops the conveyance of the first sheet P1. After stopping the conveyance of the first sheet P1, as illustrated in FIG. 6C, the switchback conveying roller pair 13 conveys the first sheet P1 in the regular direction, strikes the leading edge of the first sheet P1 against the registration roller pair 15 to correct the skew, and puts the first sheet P1 on standby.

In this way, by conveying the preceding first sheet P1 to the switchback conveyance path W3 and withdrawing the preceding first sheet P1 from the folding processing conveyance path W2, the preceding first sheet P1 does not obstruct the conveyance of a following second sheet P2, thereby enabling smooth conveyances of the following sheet P2.

Figure 6D:
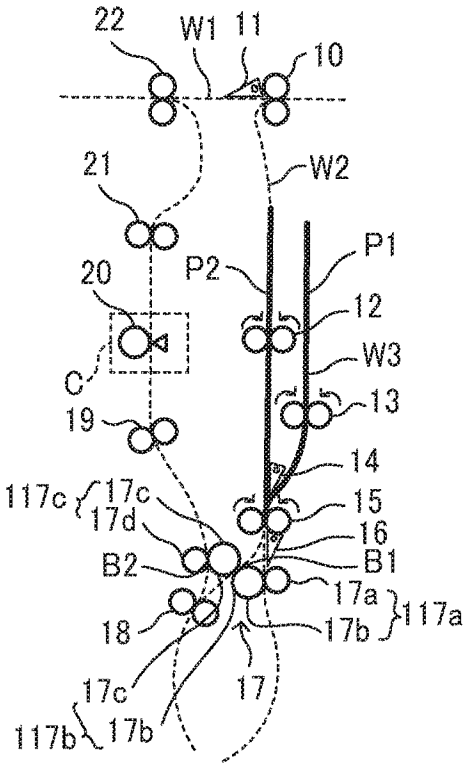
Figure 6E:
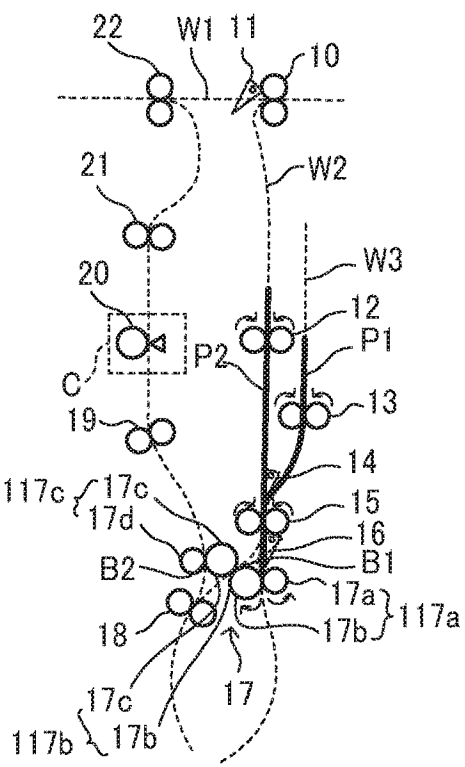
Figure 6F:
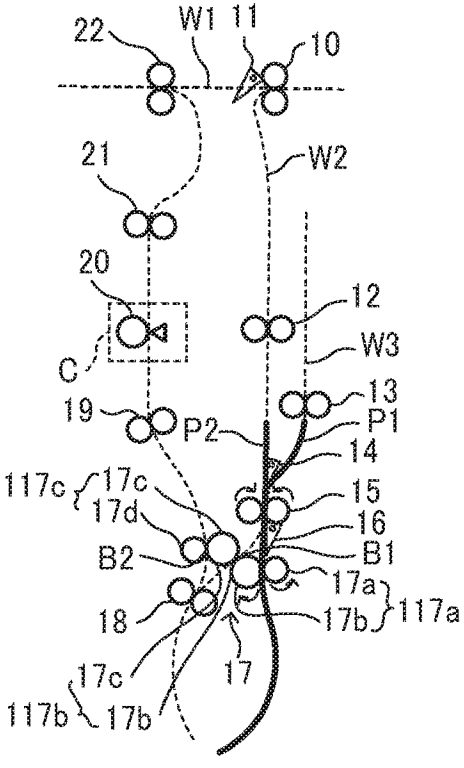

Next, a leading edge of the following second sheet P2 contacts the registration roller pair 15. As illustrated in FIG. 6D, even after the leading edge of the following sheet P2 contacts the registration roller pair 15, the conveyance roller pair 12 continues to convey the following sheet P2 and bends the following sheet P2 to correct the skew of the following sheet P2. As illustrated in FIG. 6E, after a predetermined time in which the following sheet P2 is bent by a predetermined amount has passed, the registration roller pair 15, the switchback conveying roller pair 13, and the first conveyance roller pair 117*a* rotate. As illustrated in FIG. 6F, the registration roller pair 15 conveys the first sheet P1 and the second sheet P2 in an overlaid manner.

When the number of overlaid sheets reaches the number set by the user, the folding section B starts the folding processing. On the other hand, when the number of overlaid sheets does not reach a number set by the user, the overlaid sheets are conveyed in the reverse direction when the trailing edge of the overlaid sheets has passed through the second bifurcating claw 14 and evacuates to the switchback conveyance path W3. The sheets are overlaid by repeating the above operation according to the number of sheets to be overlaid.

In the present embodiment, as described above, the skew of the following second sheet P2 is corrected without stopping the rotation of the conveyance roller pair 12, and the registration roller pair 15 starts to rotate when the bending amount of the second sheet P2 reaches the predetermined amount. Therefore, it is possible to overlay the preceding first sheet and the following second sheet without reducing the productivity.

While the number of the overlaid sheets does not reach the number set by the user, an overlay process without the skew correction by the registration roller pair 15 may be performed, and, when the number of the overlaid sheets reaches the number set by the user, the overlay process with the skew correction by the registration roller pair 15 may be performed. In the overlay process with the skew correction, the switchback conveying roller pair 13 strikes the leading edge of the preceding sheet P1 or a preceding sheet bundle against the registration roller pair 15 to correct the skew and puts the sheet P1 or the preceding sheet bundle on standby, and, after the conveyance roller pair 12 strikes the leading edge of the following sheet P2 against the registration roller pair 15 to correct the skew, the registration roller pair 15 conveys the overlaid sheets. On the other hand, in the overlay process without the skew correction, the leading edge of the preceding sheet P1 or the sheet bundle is placed in the switchback conveyance path W3 and put on standby. Then, the switchback conveying roller pair 13 starts to convey the preceding sheet P1 or the preceding sheet bundle so that the preceding sheet P1 or the preceding sheet bundle placed on the switchback conveyance path W3 reaches the registration roller pair 15 when the following sheet P2 reaches the registration roller pair 15, and the sheets are overlaid. The registration roller pair 15 conveys the overlaid sheets.

FIGS. 7A to 7D are explanatory diagrams illustrating the general operation when the folding section B performs the Z-folding processing.

The leading edge of a sheet bundle Pt conveyed by the registration roller pair 15 after the overlay process enters the first conveyance roller pair 117*a* including the first folding roller 17*b* and the first pressing roller 17*a*. Next, when the sheet bundle Pt is conveyed by a predetermined conveyance amount Δ1, a drive motor to drive the folding mechanism 17 rotates in reverse. A travel distance at this time is appropriately determined depending on the length of the sheet bundle Pt in the sheet conveyance direction and the content of the folding processing, such as the manner of folding.

Figure 7A:
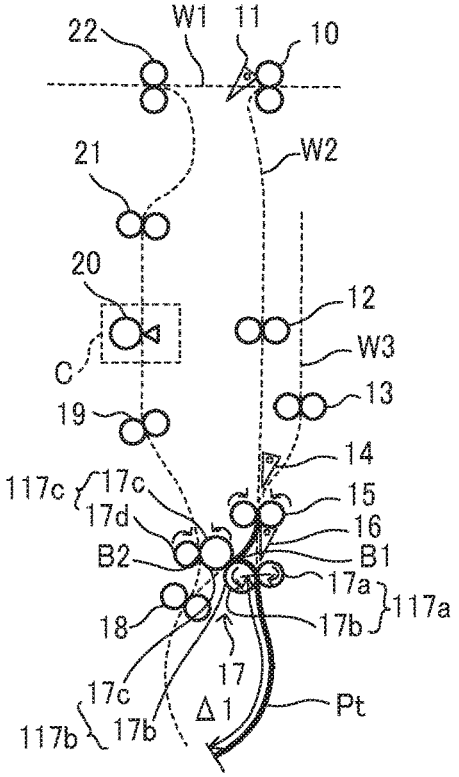
FIGS. 7A to 7D are explanatory diagrams illustrating a general operation when a folding section performs Z-folding processing.

Reverse rotation of the drive motor to drive the folding mechanism 17 conveys the sheet bundle Pt sandwiched by the first conveyance roller pair 117*a* in the reverse direction, that is, the direction opposite to the predetermined direction. This forms a bend in the sheet bundle portion between the registration roller pair 15 and the first conveyance roller pair 117*a* as illustrated in FIG. 7A. This bend, which is also called a folded-back portion, enters a nip between a first folding roller pair 117*b* including the first folding roller 17*b* and the second folding roller 17*c*, which forms the first folded portion in the folded-back portion. The first folded portion passing through the nip of the first folding roller 17*b* is conveyed toward the second conveyance roller pair 18 serving as a second conveyance member.

The first folded portion in the sheet bundle Pt enters the nip between the second conveyance roller pair 18. When the second conveyance roller pair 18 conveys the sheet bundle Pt by a predetermined conveyance amount Δ2, the second conveyance roller pair 18 rotates in reverse and conveys the sheet bundle Pt sandwiched by the second conveyance roller pair 18 in the reverse direction that is the direction opposite to the predetermined direction. The conveyance amount Δ2 is appropriately determined depending on the length of the sheet bundle Pt in the sheet conveyance direction and a content of the folding processing such as folding manner.

Figure 7B:
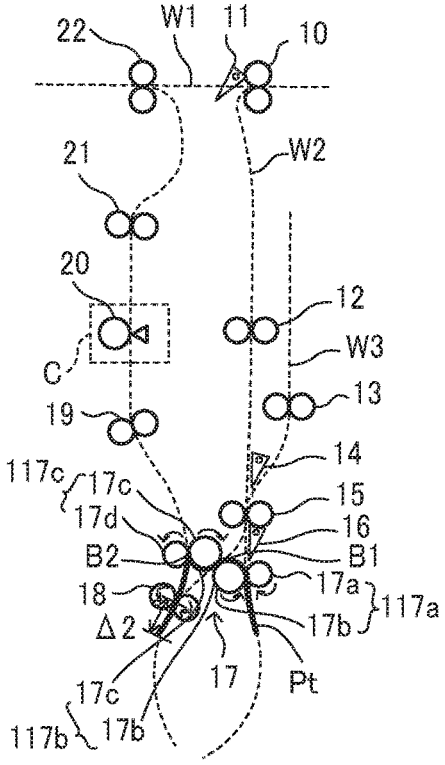

The conveyance of the sheet bundle Pt sandwiched by the second conveyance roller pair 18 in the reverse direction forms a bend in the sheet bundle between the first folding roller pair 117*b* and the second conveyance roller pair 18. As illustrated in FIG. 7B, this bend, which is also called a folded-back portion, enters a nip between a second folding roller pair 117*c* including the second folding roller 17*c* and the second pressing roller 17*d*, which forms the second folded portion in the folded-back portion.

Figure 7C:
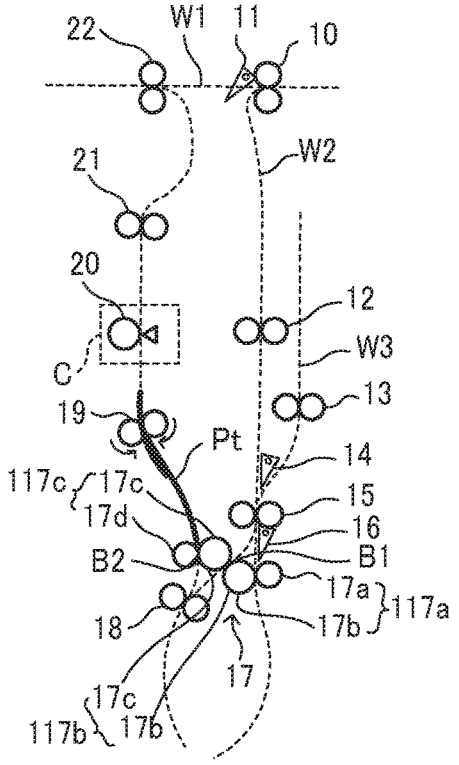
Figure 7D:
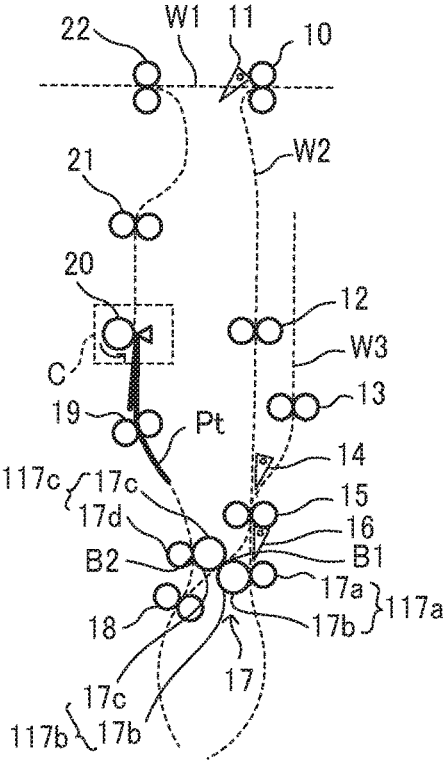

As illustrated in FIG. 7C, an intermediate conveyance roller pair 19 conveys the sheet bundle Pt including the two folded portions formed as described above, which has passed through the nip of the second folding roller pair 117*c*, toward the additional folding roller 20. As illustrated in FIG. 7D, when the second folded portion reaches the position opposite the additional folding roller 20, the conveyance of the sheet bundle Pt is stopped. Next, the additional folding roller 20 rotates to put a sharp crease at the second folded portion, and the conveyance of the sheet bundle Pt is resumed. When the first folded portion reaches the position opposite the additional folding roller 20, the conveyance of the sheet bundle Pt is stopped. The additional folding roller 20 rotates to put a sharp crease at the first folded portion, and the conveyance of the sheet bundle Pt is resumed. Two conveyance roller pairs 21 and 22 convey the sheet bundle Pt, and the conveyance roller pair 22 ejects the sheet bundle Pt to the post-processing apparatus 2.

In the above description, the sheet bundle Pt after the overlay process is folded. The folding processing operation to fold one sheet is also the same. In the above description, Z-folding processing is described. The same operation as the Z-folding processing in which the conveyance amount Δ1 and the conveyance amount Δ2 are appropriately changed enables executing the inner three-fold and the outer three-fold. In double folding processing, the third bifurcating claw 16 pivots in the clockwise direction in FIGS. 7A to 7D to adopt a posture for guiding the sheet to the first folding roller pair 117*b*, and the sheet conveyed from the registration roller pair 15 is conveyed to the first folding roller pair 117*b*. Then, the same operation as the above-described operation to form the second folded portion forms the folded portion at the center of the sheet in the conveyance direction, which enables double folding.

Next, a description is given of the detailed configuration of the sheet processing apparatus according to the present embodiment.

Figure 8:
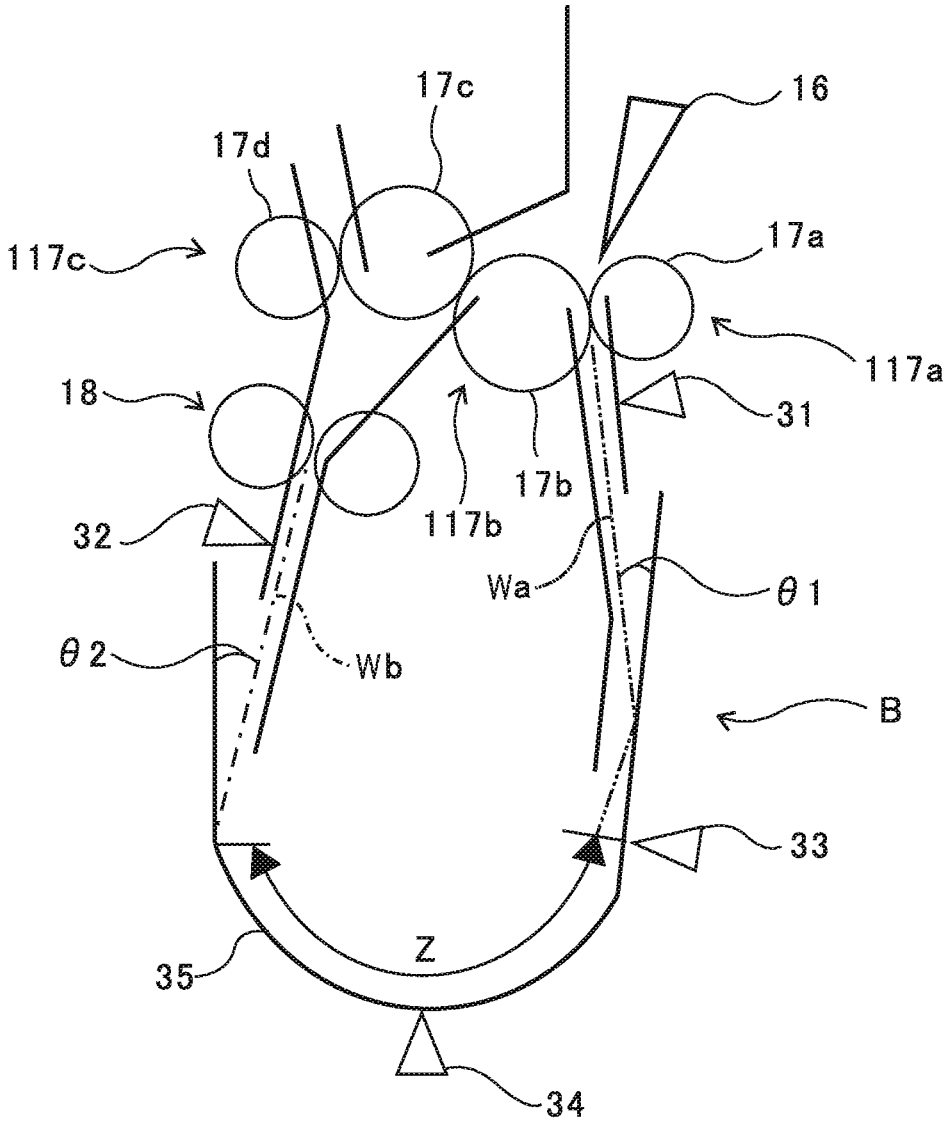
FIG. 8 is an enlarged schematic diagram of the folding section.

FIG. 8 is an enlarged schematic diagram of the folding section B.

As illustrated in FIG. 8, in the folding section B according to the present embodiment, the first conveyance roller pair 117*a* and the second conveyance roller pair 18 are disposed so that a guide portion to guide the sheet conveyed in the regular direction from the first conveyance roller pair 117*a* on the downstream side of the first conveyance roller pair 117*a* and a guide portion to guide the sheet conveyed from the second conveyance roller pair 18 on the downstream side of the second conveyance roller pair 18 are at least partially shared, that is, a portion Z in FIG. 8 exists. Specifically, the first conveyance roller pair 117*a* and the second conveyance roller pair 18 are disposed so that the sheet conveyed in the regular direction from the first conveyance roller pair 117*a* and the sheet conveyed in the regular direction from the second conveyance roller pair 18 are conveyed toward the same direction which is, for example, a downward direction in FIG. 8, that is, both of the sheets are conveyed to the same region under the first conveyance roller pair 117*a* and the second conveyance roller pair 18. Therefore, a guide disposed under the first conveyance roller pair 117*a* and the second conveyance roller pair 18 can guide the sheet conveyed in the regular direction from the first conveyance roller pair 117*a* and the sheet conveyed in the regular direction from the second conveyance roller pair 18.

A first sheet detector 31 is disposed in the vicinity of the first conveyance roller pair 117*a* and downstream in the sheet conveyance direction (hereinafter also simply referred to as the downstream side) that is the direction when the first conveyance roller pair 117*a* conveys the sheet in the regular direction. The first sheet detector 31 outputs a signal which is a trigger to measure the above-described conveyance amount Δ1. The controller 40 described above can obtain the above-described conveyance amount Δ1 based on a rotation amount of the first conveyance roller pair 117*a* from when the controller 40 receives the leading-edge detection signal output from the first sheet detector 31.

Similarly, a second sheet detector 32 is disposed in the vicinity of the second conveyance roller pair 18 and downstream from the second conveyance roller pair 18 and outputs a signal which is a trigger to measure the above-described conveyance amount Δ2. The controller 40 described above can obtain the above-described conveyance amount Δ2 based on a rotation amount of the second conveyance roller pair 18 from when the controller 40 receives the leading-edge detection signal output from the second sheet detector 32.

A guide 35 has a substantially U-shaped cross section and has a guide shape to change the sheet conveyance direction by 90° or more. One end of the guide 35 is positioned on the first sheet conveyance path Wa downstream from the first conveyance roller pair 117*a*, and the other end of the guide 35 is positioned on the second sheet conveyance path Wb downstream from the second conveyance roller pair 18. The above-described guide shape of the guide 35 that changes the sheet conveyance direction by 90° or more allows the apparatus to be made more compact The alternate long and two short dashes line in FIG. 8 indicates the first sheet conveyance path Wa, and the alternate long and short dash line in FIG. 8 indicates the second sheet conveyance path Wb. Further, a range of the portion Z in FIG. 8 is a shared conveyance area of the first sheet conveyance path Wa and the second sheet conveyance path Wb, that is, a shared guide area of the first sheet conveyance path Wa and the second sheet conveyance path Wb. In the present embodiment, the shared conveyance area Z that is the shared guide area is disposed on the first sheet conveyance path Wa and the second sheet conveyance path Wb. In the shared conveyance area Z that is the shared guide area, the guide can guide the sheet on the first sheet conveyance path Wa or the second sheet conveyance path Wb. This configuration can reduce the apparatus size and the cost of the apparatus due to decrease of a number of components.

A length of the first conveyance path Wa+a length of the shared conveyance area Z that is the shared guide area and a length of the second conveyance path Wb+the length of the shared conveyance area Z that is the shared guide area are enough if each length is a maximum length of a maximum size sheet in the sheet conveyance direction in which the folding apparatus 1 can perform the folding processing, for example, the maximum length of A3 size. This is because trailing edge of the sheet does not enter the first sheet conveyance path Wa and the second sheet conveyance path Wb. Additionally, in the present embodiment, since the conveyance amount of the sheet conveyed to the second sheet conveyance path Wb is smaller than the conveyance amount of the sheet conveyed to the first sheet conveyance path Wa, the length of the second sheet conveyance path Wb is set shorter than the first sheet conveyance path Wa.

The folding section B is configured so that the sheet conveyed by the first conveyance roller pair 117*a* and the sheet conveyed by the second conveyance roller pair 18 contact the guide surface of the guide 35 at an angle. More specifically, the angle formed between a guide that receives the sheet ejected by the first conveyance roller pair 117*a* and the guide surface on which the guide 35 receives the sheet is an acute angle. The angle formed between a guide that receives the sheet ejected by the second conveyance roller pair 18 and the guide surface on which the guide 35 receives the sheet is also an acute angle. As a result, the sheet ejected by the first conveyance roller pair 117*a* contacts the guide surface on which the guide 35 receives the sheet at the acute angle θ1. Similarly, the sheet ejected by the second conveyance roller pair 18 contacts the guide surface on which the guide 35 receives the sheet at the acute angle θ2. This configuration can smoothly guide, to the guide 35, the leading edge of the sheet conveyed by the first conveyance roller pair 117*a* and the leading edge of the sheet that includes the first folded portion conveyed by the second conveyance roller pair 18.

In addition, a guide is not disposed opposite the shared conveyance area Z (the shared guide area) of the first sheet conveyance path Wa and the second sheet conveyance path Wb on the guide 35, and the shared conveyance area Z has an opening. A first shared sheet detector 33 and a second shared sheet detector 34 to detect the sheet are disposed on the shared conveyance area Z (the shared guide area). The first shared sheet detector 33 and the second shared sheet detector 34 detect whether the sheet exists in the shared conveyance area Z (the shared guide area) when malfunction such as a sheet jam occurs and are used for detection related to jam processing such as sheet removal. Setting one sensor to detect whether the sheet exists in the shared conveyance area Z (the shared guide area) enables the sensor to detect whether the sheet exists in each of the first sheet conveyance path Wa and the second sheet conveyance path Wb. As a result, a number of components can be reduced, thus reducing the cost of the folding apparatus.

In the present embodiment, a reflective optical sensor is used as the first shared sheet detector 33 and the second shared sheet detector 34. Alternatively, a feeler sensor in which a transmission optical sensor detects movement of a feeler may be used.

Figure 9:
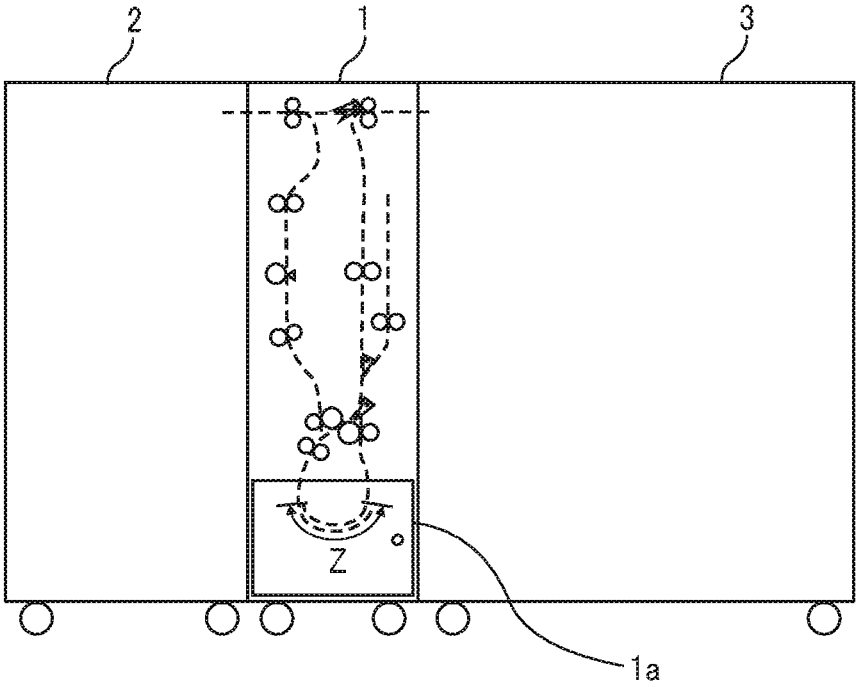
FIG. 9 is a schematic configuration diagram illustrating a door of the folding apparatus.

FIG. 9 is a schematic configuration diagram illustrating a door 1*a* of the folding apparatus 1. As illustrated in FIG. 9, opening the door 1*a* exposes the shared conveyance area Z (the shared guide area). As described above, the shared conveyance area Z (the shared guide area) has the opening which does not have the guide opposite the guide 35. Therefore, the sheet remaining in the shared conveyance area Z (the shared guide area) can be easily removed when the malfunction such as the sheet jam stops operation of the folding apparatus. Opening the shared conveyance area enables easy removal of the remaining sheet in each of the first sheet conveyance path WA and the second sheet conveyance path Wb.

Next, a description is given of a folding apparatus according to variations.

First Variation

Figure 10:
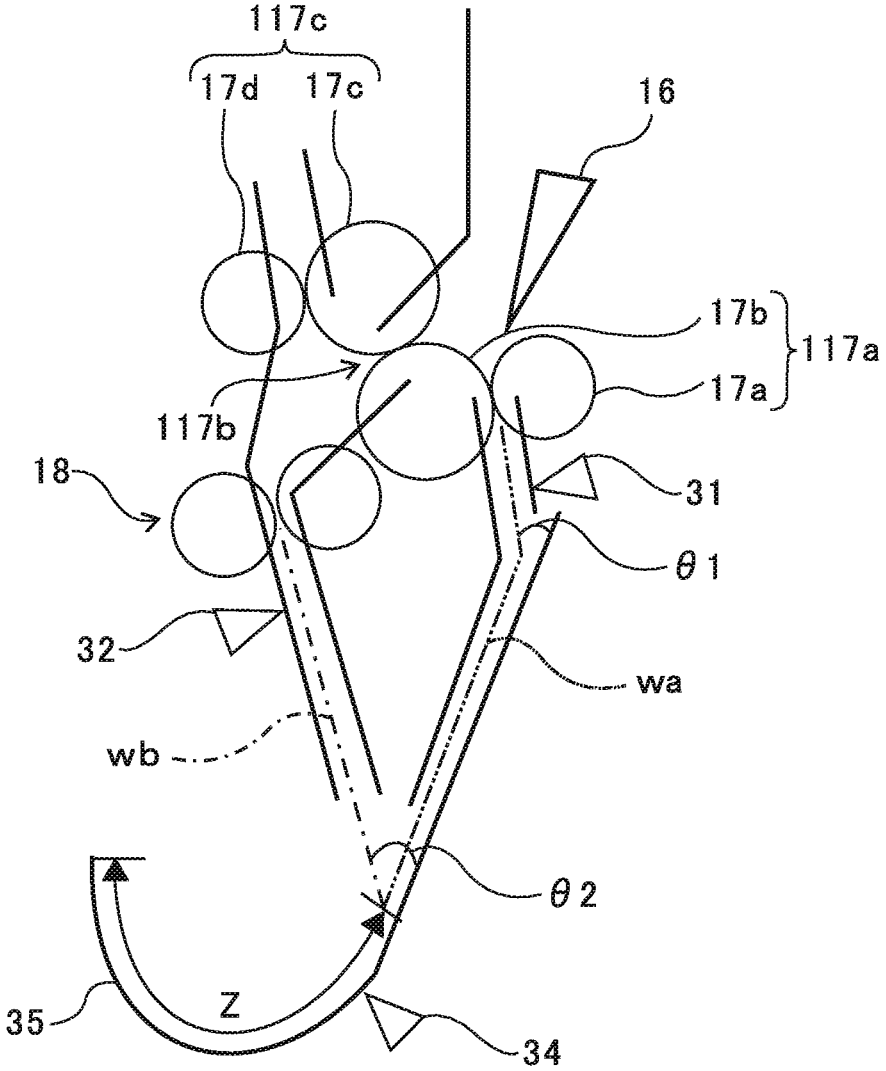
FIG. 10 is an enlarged schematic diagram illustrating a configuration of a folding section according to a first variation.

FIG. 10 is a schematic diagram illustrating the folding section B according to a first variation.

In a configuration of the first variation, the second sheet conveyance path Wb extends to the first sheet conveyance path Wa and meets the first sheet conveyance path Wa, and the guide 35 guides the sheet in the first sheet conveyance path Wa and the sheet in the second sheet conveyance path Wb in the same direction. In other words, in the shared conveyance area Z (the shared guide area), a sheet conveyance direction of the sheet in the first sheet conveyance path Wa is the same as a sheet conveyance direction of the sheet in the second sheet conveyance path Wb. In the above-described configuration, the first sheet conveyance path Wa and the second sheet conveyance path Wb can be brought close to each other, and the folding apparatus can be downsized, compared to the configuration in which the guide 35 guides the sheet in the first conveyance path Wa and the sheet in the second conveyance path Wb in mutually different directions.

In the first variation, the guide opposite the guide 35 is not also disposed in the shared conveyance area Z (the shared guide area), and the shared conveyance area Z is opened to make it easy to remove the remaining sheets when the malfunction stops the operation of the folding apparatus. Setting the second shared sheet detector 34 to detect whether the sheet exists in the shared conveyance area Z (the shared guide area) when the malfunction such as the sheet jam occurs enables detection of whether the sheet exists in each of the first sheet conveyance path Wa and the second sheet conveyance path Wb.

The guide 35 in the first variation also has a substantially U-shaped cross section and has a guide shape to change the sheet conveyance direction by 90° or more, which reduces the apparatus size.

In the first variation, the angle formed between the guide that receives the sheet ejected by the first conveyance roller pair 117*a* and the guide surface on which the guide 35 receives the sheet and the angle formed between the guide that receives the sheet ejected by the second conveyance roller pair 18 and the guide surface on which the guide 35 receives the sheet are also acute angles. As a result, the sheet ejected by the first conveyance roller pair 117*a* contacts the guide surface on which the guide 35 receives the sheet at the acute angle θ1. Similarly, the sheet ejected by the second conveyance roller pair 18 contacts the guide surface on which the guide 35 receives the sheet at the acute angle θ2. This configuration can smoothly guide the sheet to the guide 35.

Second Variation

Figure 11:
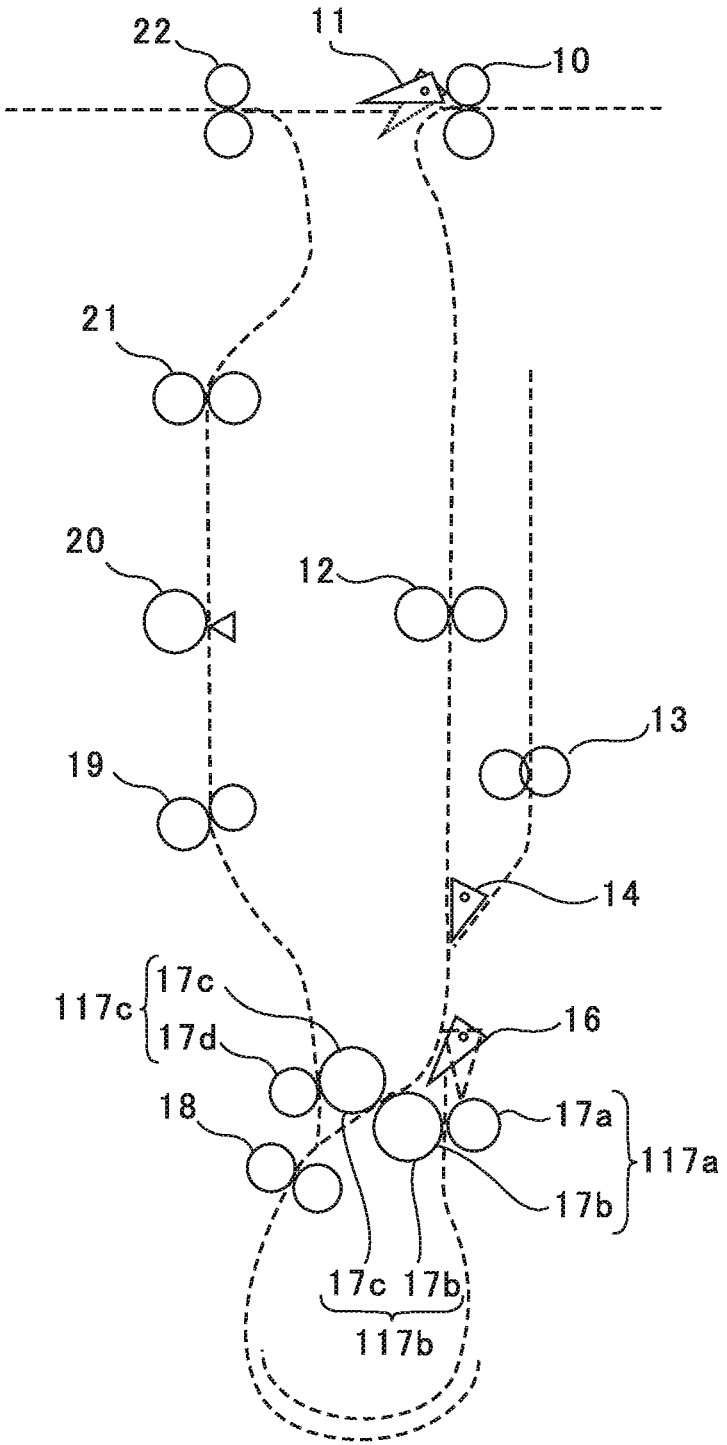
FIG. 11 is a schematic diagram illustrating a sheet processing apparatus according to a second variation.

FIG. 11 is a schematic diagram illustrating a sheet processing apparatus according to a second variation.

The folding processing apparatus in the second variation use the first conveyance roller pair 117*a* including the first pressing roller 17*a* and the first folding roller 17*b* as the registration roller pair.

In the overlay process, the preceding sheet P1 contacts the first conveyance roller pair 117*a* to correct the skew. After the skew is corrected, the first conveyance roller pair 117*a* conveys the preceding sheet P1 to the switchback conveyance path W3 in the same manner as described above. Subsequently, the leading edge of the preceding sheet P1 contacts the first conveyance roller pair 117*a* again and is held. Next, the following sheet P2 contacts the first conveyance roller pair 117*a* to correct the skew. Next, the preceding sheet P1 and the following sheet P2 are overlaid, and the first conveyance roller pair 117*a* rotates in the regular direction and conveys the sheet bundle of the preceding sheet P1 and the following sheet P2 in the regular direction by a predetermined conveyance amount. During this conveyance in the regular direction, the bending of the preceding sheet P1 and the following sheet P2 is canceled. Specifically, the rotation speed of the first conveyance roller pair 117*a* that is a sheet conveyance speed moved by the first conveyance roller pair 117*a* is set to be higher than the rotation speed of the conveyance roller pair 12 and the switchback conveying roller pair 13 that is a sheet conveyance speed moved by the conveyance roller pair 12 and the switchback conveying roller pair 13, and this speed difference cancels the bending of the sheet bundle of the preceding sheet P1 and the following sheet P2 while the sheet bundle of the preceding sheet P1 and the following sheet P2 is conveyed by the predetermined conveyance amount.

After the sheet bundle is conveyed by the predetermined conveyance amount, with reference to FIG. 11, the third bifurcating claw 16 pivots from the position indicated by the dotted line to the position indicated by the solid line and pushes the folded-back portion of the sheet bundle toward the first folding roller pair 117*b*. At the same time, the first conveyance roller pair 117*a* rotates in the reverse direction to convey the sheet bundle in the reverse direction. This rotation bends the sheet bundle, and the bend of the sheet bundle enters the nip between the first folding roller pair 117*b*, which forms the first folded portion in the sheet bundle. After the first folded portion is formed, similarly to the above, the first folded portion is conveyed to the second conveyance roller pair 18. The second conveyance roller pair 18 conveys the sheet bundle in the regular direction by a predetermined conveyance amount and conveys in the reverse direction. This forms the bend in the sheet bundle between the first folding roller pair 117*b* and the second conveyance roller pair 18, and the bend that is the folded-back portion enters the nip between the second folding roller pair 117*c* to form the second folded portion.

Further, in the present embodiment, a belt member may be used as the first pressing roller 17*a*, the first folding roller 17*b*, the second folding roller 17*c*, the second pressing roller 17*d*, and the second conveyance roller pair 18.

The embodiments described above are but examples and provide the following advantages from a first aspect to a tenth aspect.

First Aspect

In a first aspect, a sheet processing apparatus includes a first conveyer such as the first conveyance roller pair 117*a* rotatable in forward and reverse to convey a sheet, a first folding device such as the first folding roller pair 117*b* to fold the sheet and put a crease in the sheet, a second conveyer such as the second conveyance roller pair 18 rotatable in forward and reverse to convey the sheet folded by the first folding device, a second folding device such as the second folding roller pair 117*c* to fold the sheet and put a crease in the sheet, and a guide such as the guide 35 to guide the sheet conveyed downstream of the first conveyer and the sheet conveyed downstream of the second conveyer.

Since the guide guides the sheet conveyed downstream of the first conveyer and the sheet conveyed downstream of the second conveyer, this lowers the cost of the sheet processing apparatus and reduces the size of the sheet processing apparatus compared to the sheet processing apparatus in which the sheet conveyed downstream of the first conveyer and the sheet conveyed downstream of the second conveyer are separately guided.

Second Aspect

In a second aspect, the guide such as the guide 35 of the sheet processing apparatus according to the first aspect guides the sheet conveyed from the first conveyer such as the first conveyance roller pair 117*a* at a downstream side from the first conveyer and guides the sheet conveyed from the second conveyer such as the second conveyance roller pair 18 at a downstream side of the second conveyer.

This prevents the guide such as the guide 35 from increasing in size and enables the guide to guide the sheet conveyed downstream of the first conveyer and the sheet conveyed downstream of the second conveyer.

Third Aspect

In a third aspect, the sheet processing apparatus according to the first aspect includes a first detector such as the first sheet detector 31 to detect the sheet at a position downstream of the first conveyer such as the first conveyance roller pair 117*a*, a second detector such as the second sheet detector 32 to detect the sheet at a position downstream of the second conveyer such as the second conveyance roller pair 18. After the first detector detects the sheet, the first conveyer rotates in reverse and performs first folding processing, and, after the second detector detects the sheet, the second conveyer rotates in reverse and performs second folding processing. The guide guides the sheet at a position downstream of the first detector and the second detector.

In the third aspect, the guide can guide the sheet switched back by the first conveyer such as the first conveyance roller pair 117*a* and the sheet switched back by the second conveyer such as the second conveyance roller pair 18.

Fourth Aspect

In a fourth aspect, the sheet conveyed downstream by the first conveyer such as the first conveyance roller pair 117*a* and the sheet conveyed downstream by the second conveyer such as the second conveyance roller pair 18 contact, at an angle, a guide surface of the guide of the sheet processing apparatus according to the first aspect.

In the fourth aspect, the guide such as the guide 35 can smoothly guide the leading edge of the sheet.

Fifth Aspect

In a fifth aspect, a guide shape of the guide of the sheet processing apparatus according to the first aspect changes a conveyance direction of the sheet by 90° or more.

The sheet processing apparatus according to the fifth aspect can be smaller than the sheet processing apparatus in which the guide changes the conveyance direction of the sheet by less than 90°.

Sixth Aspect

In a sixth aspect, the guide such as the guide 35 of the sheet processing apparatus according to the first aspect has an opening in which a part of the sheet is exposed.

In the sixth aspect, the user can remove, from the opening, the sheet left downstream from the first conveyer such as the first conveyance roller pair 117*a* and the sheet left downstream from the second conveyer such as the second conveyance roller pair 18.

Seventh Aspect

In a seventh aspect, the sheet processing apparatus according to the first aspect includes a sheet detector such as the first shared sheet detector 33 to detect the sheet on a shared guide area such as the shared guide area Z to guide the sheet on the guide conveyed downstream of the first conveyer such as the first conveyance roller pair 117*a* and the sheet on the guide conveyed downstream of the second conveyer such as the second conveyance roller pair 18.

In a seventh aspect, the sheet processing apparatus according to the first aspect includes a sheet detector such as the first shared sheet detector 33 to detect the sheet on a shared guide area such as the shared guide area Z to guide the sheet on the guide conveyed downstream of the first conveyer such as the first conveyance roller pair 117*a* and the sheet on the guide conveyed downstream of the second conveyer such as the second conveyance roller pair 18. Therefore, the seventh aspect can decrease a number of components and the cost of the sheet processing apparatus compared to an aspect in which the sheet processing apparatus includes two sheet detectors, that is, a sheet detector to detect the sheet conveyed downstream from the first conveyer and another sheet detector to detect the sheet conveyed downstream from the second conveyer.

Eighth Aspect

In an eighth aspect, the guide such as the guide 35 of the sheet processing apparatus according to the first aspect guides the sheet conveyed downstream from the first conveyer such as the first conveyance roller pair 117*a* in a direction opposite to a guide direction in which the guide guides the sheet conveyed from the second conveyer such as the second conveyance roller pair 18.

In the eighth aspect, the guide such as the guide 35 can guide the sheet conveyed downstream from the first conveyer such as the first conveyance roller pair 117*a* and the sheet conveyed downstream from the second conveyer such as the second conveyance roller pair 18 without combining a sheet conveyance path downstream from the first conveyer such as the first conveyance roller pair 117*a* and a sheet conveyance path downstream from the second conveyer such as the second conveyance roller pair 18.

Ninth Aspect

In a ninth aspect, the guide such as the guide 35 of the sheet processing apparatus according to the first aspect guides the sheet conveyed downstream from the first conveyer such as the first conveyance roller pair 117*a* in the same direction as a guide direction in which the guide guides the sheet conveyed from the second conveyer such as the second conveyance roller pair 18.

As described in the first variation, the sheet processing apparatus according to the ninth aspect can be smaller than the sheet processing apparatus in which a guide direction of the guide to guide the sheet conveyed downstream from the first conveyer such as the first conveyance roller pair 117*a* is opposite to the guide direction of the guide to guide the sheet conveyed downstream from the second conveyer such as the second conveyance roller pair 18.

Tenth Aspect

In a tenth aspect, the image forming system 4 includes the image forming apparatus such as the image forming apparatus 3 to form the image on the sheet and the sheet processing apparatus according to the first aspect such as the folding apparatus 1 to perform predetermined processing on the sheet.

The tenth aspect can reduce the size and the cost of the image forming system.

Numerous additional modifications and variations are possible in light of the above teachings. It is therefore to be understood that, within the scope of the above teachings, the present disclosure may be practiced otherwise than as specifically described herein. Such variations are not to be regarded as a departure from the scope of the present disclosure and appended claims, and all such modifications are intended to be included within the scope of the present disclosure and appended claims.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A sheet processing apparatus comprising:

a first conveyer to convey a sheet, the first conveyer rotatable in reverse;

a first folding device to fold the sheet and put a crease in the sheet;

a second conveyer to convey the sheet folded by the first folding device, the second conveyer rotatable in reverse;

a second folding device to fold the sheet and put a crease in the sheet; and a guide for a shared switch back conveyance path, the guide being configured to guide the sheet conveyed and held by the first conveyer before the sheet is first folded by the first folding device, and configured to guide the sheet conveyed and held by the second conveyer before the sheet is second folded by the second folding device, and the sheet guided by the guide is conveyed in reverse by the first conveyer or the second conveyer.

2. The sheet processing apparatus according to claim 1, wherein at least one part of the guide guides the sheet conveyed from the first conveyer at a downstream side from the first conveyer and guides the sheet from the second conveyer at a downstream side from the second conveyer.

3. The sheet processing apparatus according to claim 1, further comprising:

a first detector to detect the sheet at a position downstream from the first conveyer;

a second detector to detect the sheet at a position downstream from the second conveyer; and circuitry to cause the first conveyer to rotate in reverse and perform first folding processing after the first detector detects the sheet, and cause the second conveyer to rotate in reverse and perform second folding processing after the second detector detects the sheet, wherein the guide guides the sheet at a position downstream from the first detector and the second detector.

4. The sheet processing apparatus according to claim 1, wherein the guide has a guide surface to contact the sheet conveyed downstream by the first conveyer and the sheet conveyed downstream by the second conveyer at an angle.

5. The sheet processing apparatus according to claim 1, wherein the guide is shaped to change a conveyance direction of the sheet by 90° or more.

6. The sheet processing apparatus according to claim 1, wherein the guide has an opening where a part of the sheet is exposed.

7. The sheet processing apparatus according to claim 1, further comprising a sheet detector to detect the sheet on a shared guide area to guide the sheet on the guide conveyed downstream from the first conveyer and the sheet on the guide conveyed downstream from the second conveyer.

8. The sheet processing apparatus according to claim 1, wherein the guide guides the sheet conveyed downstream from the first conveyer in a direction opposite to a guide direction in which the guide guides the sheet conveyed from the second conveyer.

9. The sheet processing apparatus according to claim 1, wherein a conveyance direction of the sheet on the guide conveyed downstream by the first conveyer is same as a conveyance direction of the sheet on the guide conveyed downstream by the second conveyer.

10. An image forming system comprising:

an image forming apparatus to form an image on a sheet; and the sheet processing apparatus according to claim 1 to perform predetermined processing on the sheet.

11. The sheet processing apparatus according to claim 1, further comprising a shared conveyance area between the first conveyer and the second conveyer, wherein the guide is open to the shared conveyance area.

12. The sheet processing apparatus according to claim 1, wherein the guide is a curved guide disposed on the shared switchback conveyance path, the shared switchback conveyance path being between the first conveyor and the second conveyor.

* * * * *